US005762772A

United States Patent [19]

Tomono et al.

[11] Patent Number: 5,762,772

[45] Date of Patent: Jun. 9, 1998

[54] METHOD AND APPARATUS FOR IMAGE FORMATION

[75] Inventors: Takao Tomono; Makoto Furuki; Shigemi Ohtsu; Lyong Sun Pu, all of Ashigarakami-gun, Japan

[73] Assignee: Fuji Xerox Co., Ltd., Tokyo, Japan

[21] Appl. No.: 706,248

[22] Filed: Sep. 4, 1996

[30] Foreign Application Priority Data

Sep. 5, 1995 [JP] Japan ..... 7-228319

[51] Int. Cl.[6] ..... C25D 13/02

[52] U.S. Cl. ..... 204/478; 204/512; 204/490; 205/317; 101/489

[58] Field of Search ..... 204/478, 490, 204/512; 101/489; 205/317

[56] References Cited

U.S. PATENT DOCUMENTS

| | | | |
|---|---|---|---|
| 4,002,475 | 1/1977 | Ott et al. | 204/478 |
| 4,013,531 | 3/1977 | Nakamura et al. | 204/478 |
| 4,427,513 | 1/1984 | Skotheim et al. | 204/478 |

FOREIGN PATENT DOCUMENTS

A-62-20560 1/1987 Japan .

A-2-142835 5/1990 Japan .

OTHER PUBLICATIONS

Konbunshi Ronbunshu, vol. 43, No. 10, pp. 725–728 (Oct. 1986).

*Primary Examiner*—Kathryn L. Gorgos
*Assistant Examiner*—Kishor Mayekar
*Attorney, Agent, or Firm*—Oliff & Berridge, PLC

[57] ABSTRACT

The transmittance of ionic dye molecules through a thin electrically conductive high polymer film is controlled to vary between at least two states of the film as selected from among oxidized, neutral and reduced states, such that the ionic dye molecules are transferred onto a recording medium, thereby forming an image. A surface of a substrate having fine pores through which the ionic dye molecules can pass is provided with the thin electrically conductive high polymer film to fabricate a cylindrical printing unit 16, which is provided in a face-to-face relationship with an electrode unit 17 such that a voltage can be applied therebetween. The printing unit 16 is filled with a solution 21 containing ionic dye molecules. When electrodes in the electrode unit 17 are supplied with a potential pattern that brings the electrically conductive high polymer to an oxidized state, the ionic dye molecules are released from the printing unit 16 to form a one-dimensional image on a moving sheet of paper 17.

9 Claims, 9 Drawing Sheets

METHOD AND APPARATUS FOR IMAGE FORMATION

BACKGROUND OF THE INVENTION

This invention relates to a method and apparatus for image formation. More particularly, the invention relates to an image forming method and apparatus which use a thin electrically conductive high polymer film to transfer ionic dye molecules onto a recording medium and which is applicable to printers, copiers and printing presses.

One of the conventional processes to mark image information on paper and other recording media is xerography. According to xerography, a latent electrostatic image is formed on a photoreceptor by corona discharge and, subsequently, toner particles are deposited on the latent image such that they are transferred onto paper and other recording media to form a visible image. Methods based on this principle are collectively referred to as "indirect marking" techniques. In recent years, a direct paper marking process referred to as "ink-jet printing" is gaining popularity and becoming dominant, particularly with printers.

Electrophotography which belongs to a direct marking process is capable of forming images at comparatively high resolution and can be operated at low running cost since toner is the only material that is consumed in the process. On the other hand, high voltage is required to form a latent electrostatic image or absorb toner particles and transfer the toner image. What is more, electrophotographic apparatus is noisy and causes other problems such as ozone generation.

The ink-jet printing technology has the disadvantage of being refractory to the effort toward higher-speed operation since it is difficult to control all dots electrically and form a head as wide as the paper on which image is to be formed. In addition, the pixel, or the minimal size of the image to be formed, is determined by the size of the head or its distance from the paper and the higher the quality of the print that is produced, the slower the printing speed.

SUMMARY OF THE INVENTION

The present invention has been accomplished under these circumstances and has as an object providing a new method of image formation that is free from the above-described defects of the conventional marking processes and which is capable of forming high-quality image consuming less electric power and other forms of energy without generating any harmful substances such as ozone.

Another object of the invention is to provide an apparatus for implementing the method.

The present inventors are undertaking R&D activities to form image with small electric power using dyes that do no harm to humans and included in this project is the study of an image forming method that dopes or dedopes electrically conductive high polymer films with dye molecules by making use of photo-induced electromotive force.

In the series of such R&D efforts, the present inventors noted two major defects of the existing technology: the conductive high polymer film has to be doped with dye molecules in each cycle of marking operation and the density of dye transfer that is effected in marking is determined by the amount of dye molecules that can be doped into the conductive high polymer film. Hence, the present inventors eliminated these drawbacks and continued their intensive studies in order to develop a mechanism that permitted constant supply of dye molecules to image forming members, thereby enabling continuous marking on those members.

The above-stated objectives of the invention can be attained by an image forming method that transfers ionic dye molecules onto a recording medium by making use of the difference in the transmittance of said ionic dye molecules through a thin electrically conductive high polymer film that is observed between two states of said thin high polymer film, one being an oxidized or reduced state and the other being a neutral state.

One way to introduce the difference in the transmittance of ionic dye molecules between two states of the thin conductive high polymer film is to bring said film into an oxidized state, thereby causing it to transmit ionic dye molecules while bringing the film into a neutral or reduced state, thereby suppressing the transmission of the dye molecules. If ions are constantly supplied to the thin conductive high polymer film which transmits the ionic dye molecules, a sharp image can continuously be formed on recording media.

The objectives of the invention can also be attained by an image forming apparatus comprising state changing means that causes a thin electrically conductive, polymer film to change between an oxidized or reduced state and a neutral state, ionic dye molecule transmittance control means that is capable of controlling the transmittance of ionic dye molecules through said thin electrically conductive high polymer film induced by said state changing means, and transfer means by which the ionic dye molecules transmitted through said thin electrically conductive high polymer film are transferred onto a recording medium.

Said state changing means changes the state of the thin electrically conductive high polymer film and said ionic dye molecule transmittance control means controls the transmittance of ionic dye molecules to form an image, which is transferred onto the recording medium by the transfer means.

BRIEF DESCRIPTION OF THE DRAWINGS

FIG. 5 shows enlarged in its lower part the essential part of said image forming apparatus;

DETAILED DESCRIPTION OF THE INVENTION

The present invention will now be described in detail. The thin electrically conductive high polymer film to be used in the invention may be formed of all kinds of electrically conductive high polymers that are capable of being oxidized or reduced electrochemically and which are susceptible to doping or dedoping of ionic dye molecules. Examples of the electrically conductive high polymers that can be used in the invention include: various one-dimensional conductive high polymers such as polyacetylenes, polydiacetylenes, polyheptadienes, polypyrroles, polythiophenes, polyanilines, polyphenylenevinylenes, polythiophenylenevinylenes, polyisothianaphthenes, polyisonaphthothiophenes, polyparaphenylenes, polyphenylene sulfides, polyphenylene oxides, polyfurans, polyphenanthrenes, polyselenophenes, polytelurophenes, polyazulenes, polyindenes, polyindoles, polyphthalocyanines, polyacenes, polyacenoacenes, polynaphthylenes, polyanthracenes, polyperinaphthalenes, polybiphenylenes, polypyridinopyridines, polycyanodienes and polyallenemethanoids; and two-dimensional conductive high polymers such as ladder polymers, pyropolymers as well as graphite.

Thin films made of these electrically conductive high polymers are formed on surfaces of substrates having fine pores through which ionic dye molecules can pass, as well as on surfaces of thin metal or semiconductor films also having fine pores through which ionic dye molecules can pass. The fine pores to be formed in surfaces of substrates and thin metal or semiconductor films have preferably sizes of 0.01–1 μm. If the size of the fine pores is smaller than 0.01 μm, it is no more than the size which two or more dye molecules would assume if they were associated into a larger particle and, hence, dyes will have considerable difficulty in passing through the pores. On the other hand, if the pores are larger than 1 μm, difficulty is involved in controlling electric charges in the thin film.

The thin electrically conductive high polymer film has preferably a thickness of about 100 nm to about 20 μm. If the film is thinner than 10 nm, it is difficult to dope with dye molecules. On the other hand, if the film is thicker than 20 μm, increased electrical resistance will develop.

The metals of which the thin metal film is to be formed are not limited to any particular types but platinum (Pt) is particularly advantageous since it is not easily oxidized. The thin semiconductor film may theoretically be formed of any kind of semiconductors that generate electric power upon exposure to light. Specifically, semiconductors are available as either inorganics or organics and typical examples of inorganic semiconductors include Si, Ge, Ga, As, CdSe, CdS, CdTe, InP, AlSb and GaP; organic semiconductors are also versatile including phthalocyanines, perylenes and PVK. Both n- and p-type semiconductors are useful in the invention.

Figure 1A:
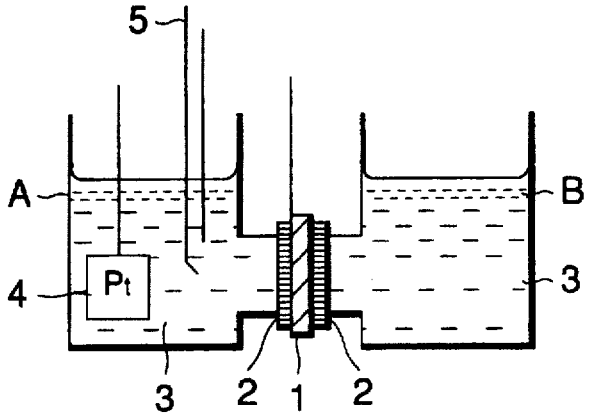
FIG. 1A shows schematically an exemplary electrolytic oxidative polymerizer for preparing the thin electrically conductive high polymer film which is to be used in the present invention.
Figure 1B:
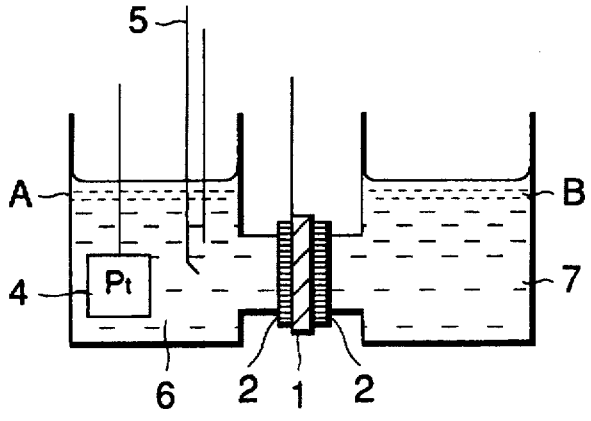
FIG. 1B shows schematically an apparatus for controlling the transmittance of ionic dye molecules using the polymerizer.

FIG. 1A shows schematically an electrolytic oxidative polymerizer for preparing the thin electrically conductive high polymer film to be used in the invention, and FIG. 1B shows the principle for controlling the transmittance of dye molecules with the polymerizer. In the polymerizer shown in FIG. 1A, a substrate 1 that has fine pores and which is provided with a metal (e.g. Pt) electrode or a transparent electrode (e.g., ITO (indium tin oxide)) by sputtering or any other suitable techniques is placed between vessels A and B, which are brought into intimate with the substrate 1 via a packing 2. Each of the vessels A and B is filled with an ion mixed aqueous solution 3 containing ionic dye molecules and an electrolytically polymerizable monomer (e.g. pyrrole). Vessel A also has a reference electrode (e.g. Pt) 4 and a counter electrode 5 disposed therein.

Figure 2B:
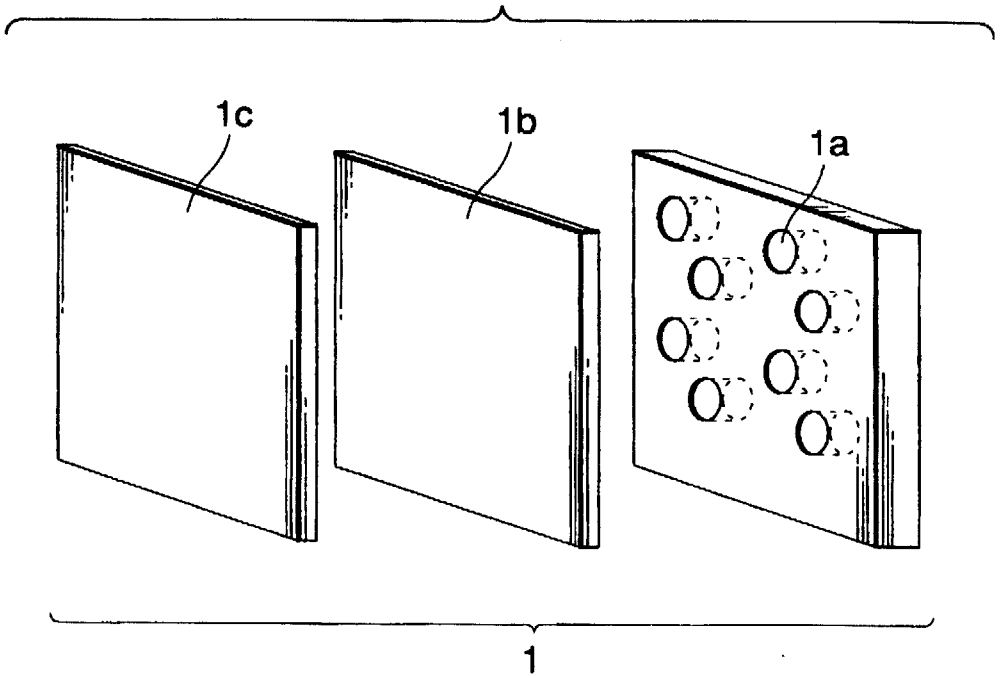
FIG. 2B is a perspective view showing the thin high polymer film as disassembled into three components.
Figure 2A:
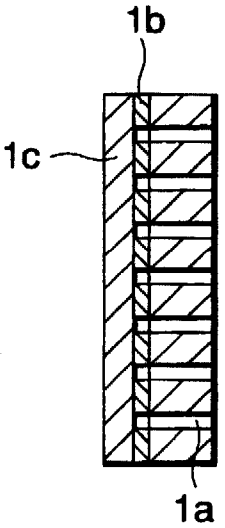
FIG. 2A is a sectional view showing the structure of a thin electrically conductive high polymer film that has ionic dye molecules introduced into a substrate by means of the polymerizer shown in FIG. 1A.

If oxidative polymerization is effected electrochemically with the system shown in FIG. 1A, the polymer film is doped with the dye molecules to form a thin electrically conductive high polymer (e.g. polypyrrole) film. Details of the thin polypyrrole film thus formed on the substrate 1 are shown in FIGS. 2A and 2B, in which FIG. 2A is a sectional view of the combination film and FIG. 2B is a perspective view showing unassembled its three components. As shown, the substrate 1 has a number of fine pores 1*a* formed therein. An electrode 1*b* made of a thin metal (e.g. Pt or ITO) film or an n- or p-type semiconductor is formed on the substrate 1 by sputtering. Like substrate 1, the electrode 1*b* has also a number of fine pores 1*a* formed in it. A surface of the electrode 1*b* is provided with a thin electrically conductive high polymer (e.g. polypyrrole) film 1*c* formed across the surface of the electrode 1*b*.

After the thin electrically conductive high polymer film has been doped with the dye molecules, vessel A is refilled with an aqueous electrolyte solution 6 and vessel B with an aqueous solution 7 containing ionic dye molecules, as shown in FIG. 1B. If the thin conductive film is brought to an oxidized state by electrochemical control or electrochemical under irradiation with light, the ionic dye molecules are taken from the vessel B to pass through the thin conductive film, from which they are released into the vessel A. If, however, the thin conductive film is brought to either a neutral or reduced state, the ionic dye molecules are no longer capable of passing through the film.

Figure 3:
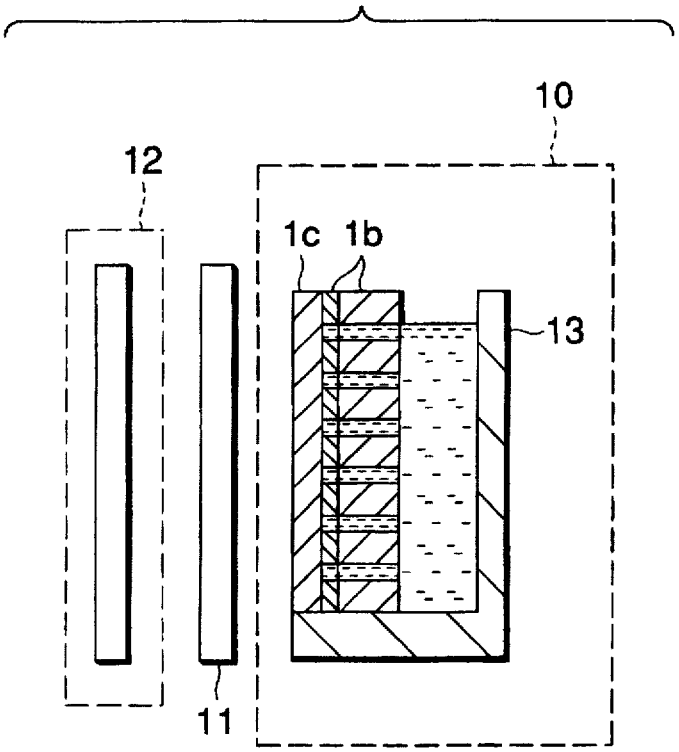
FIG. 3 illustrates the principle of image formation by the method of the invention.

This operating principle may be implemented as shown in FIG. 3 to insure constant supply of ionic dye molecules which are to be transferred onto a recording medium.

Referring to FIG. 3, a printing unit 10, a recording medium 11 such as paper and an electrode unit 12 combine to realize an image forming apparatus. Printing unit 10 has one lateral side made of a substrate having a number of fine pores which, as shown in FIGS. 2A and 2B, comprises an electrode 1*b* in the form of a thin Pt or semiconductor film or the like and an overlying thin electrically conductive high polymer film (e.g. polypyrrole) 1*c* which has been prepared by electrolytic oxidative polymerization, and the other lateral side and the bottom of the printing unit 10 are defined by a case 13. Electrode unit 12 has a substrate provided with a matrix, a thin metal film or the like.

As shown in FIG. 3, the recording medium 11 impregnated with an electrolyte solution is held closely between the printing unit 10 and the electrode unit 12. A voltage is applied between the electrode 1*b* in the printing unit 10 and the electrode unit 12 such that the thin conductive high polymer film 1*c* is brought to an oxidized state, whereupon the ionic dye molecules in the case 13 are passed through the film 1*c* to be transferred onto the recording medium 11 to form an image. Thus, by replenishing the case 13 with a solution containing ionic dye molecules, one can ensure that the ionic dye molecules are continually transferred onto the recording medium 11.

Figure 4A:
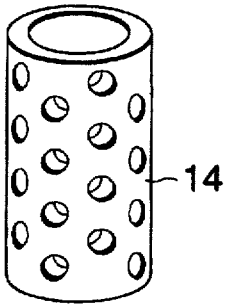
FIG. 4A illustrates a cylindrical substrate for use in the invention.
Figure 4B:
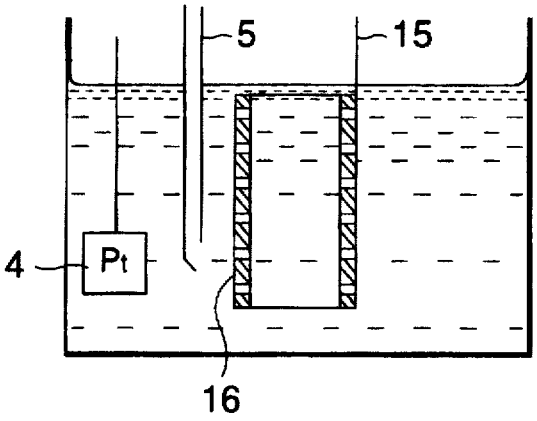
FIG. 4B is a perspective view showing the printing unit fabricated by the method shown in FIG. 4A.

FIG. 4A shows a cylindrical substrate suitable for forming a one-dimensional image, and FIG. 4B shows the printing unit fabricated by the method. A cylindrical substrate 14 (see FIG. 4A) having a number of fine pores in the wall is provided with a thin metal (e.g. Pt) film over the entire lateral surface by sputtering or vapor deposition. As shown in FIG. 4B, the thus treated cylindrical substrate 14 is submerged within a solution in a vessel that contains ionic dye molecules and an electrolytic polymerizable monomer (e.g. pyrrole). A lead wire 15 extending from the thin metal film formed over the entire lateral surface of the cylindrical substrate 14 having a number of fine pores is used as a working electrode. A reference electrode 4 (optionally having a penetrating salt bridge) and a counter electrode 5 are set up within the vessel as shown in FIG. 4B.

By applying a constant polymerization potential for a specified period of time, one can fabricate a printing unit 16 which has a thin polypyrrole film formed over the thin metal film.

Figure 5:
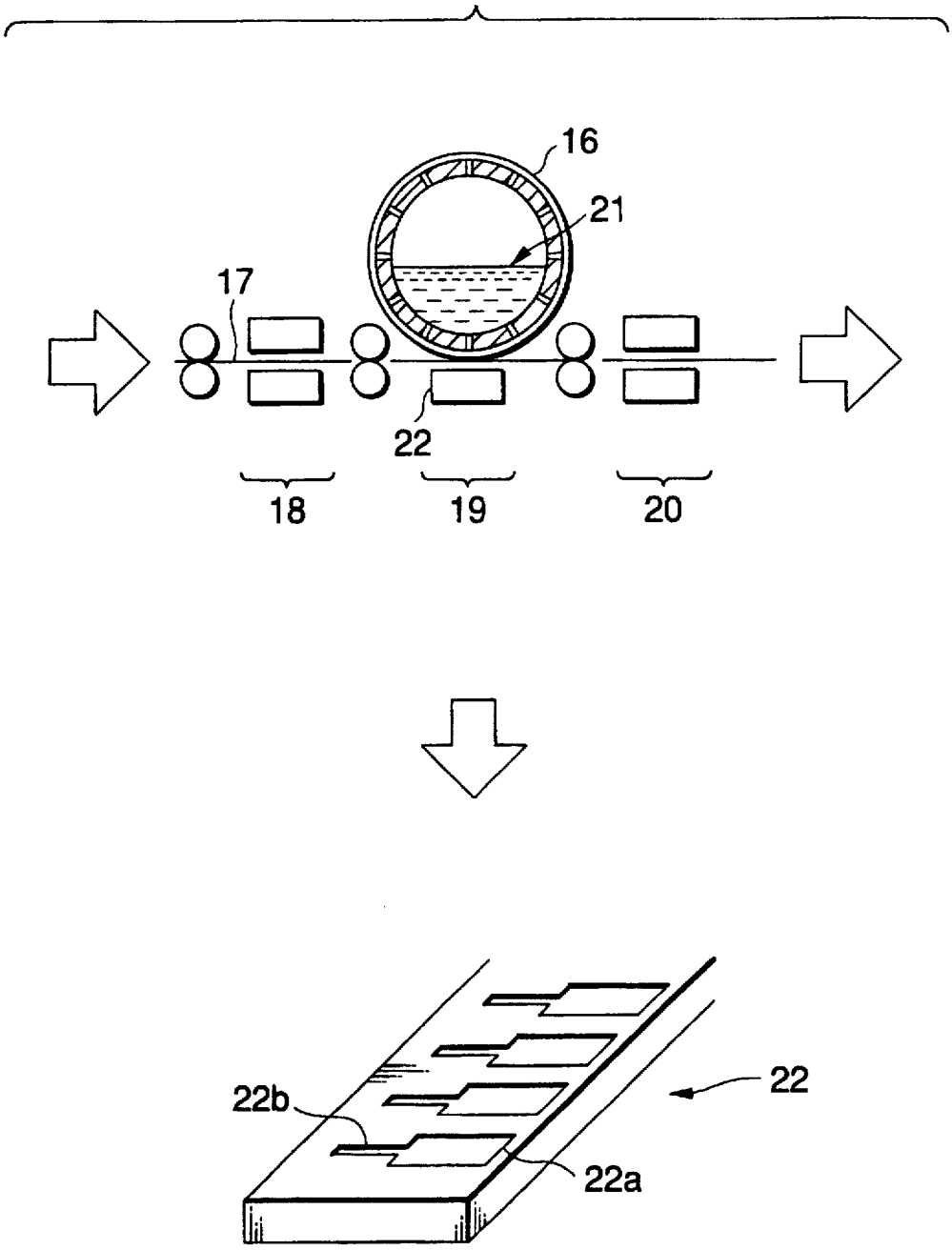
FIG. 5 shown schematically in its upper part an example of the image forming apparatus of the invention.

The thus fabricated printing unit 16 may be incorporated in an image forming apparatus as shown in FIG. 5. A sheet of paper 17 as a recording medium flows from left to right in the direction of arrows. The sheet 17 is first directed to dampening zone 18, where a pad containing NaCl is stamped onto the sheet 17. As a result, the entire surface of the sheet 17 becomes wet with an aqueous solution of NaCl. The wet sheet 17 is guided by roll pairs to flow into a printing zone 19.

In the printing zone 19, the printing unit 16 fabricated by the method illustrated in FIGS. 4A and 4B is employed. The printing unit 16 contains a solution 21 of ionic dye molecules. An electrode unit 22 is provided with an array of metal electrode pads **22*a* as shown in the lower portion of FIG. 5. Conductors 22*b* may be driven by either simple or TFT matrix accessing. In the printing zone 19, the printing unit 16, sheet 17 and electrode unit 22 are brought close to one another and a potential sufficient to bring the conductive high polymer to an oxidized state is applied between the printing unit 16 the electrode 22*a* in the electrode unit 22, whereupon ionic dye molecules are released from within the printing unit 16 to produce a print in an area of the sheet that corresponds to the area of one electrode 22*a*. A one-dimensional image is formed by providing the group of electrodes in the electrode unit 22** with a sufficient potential pattern to bring the conductive high polymer to an oxidized state.

While the printing unit 16 rotates, the sheet 17 is fed continuously and a voltage pattern is applied to the electrode unit 22 in specified positions, whereby a two-dimensional image is printed on the sheet 17. Since the as-printed sheet 17 is still wet, it is subsequently dried in a heating zone 20, which completes the printing process.

Figure 6A:
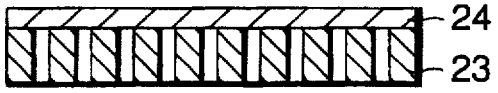
FIGS. 6A to 6F shows a step sequence for an exemplary method of fabricating a printing unit for use in the formation of a two-dimensional image according to the present invention.
Figure 6B:
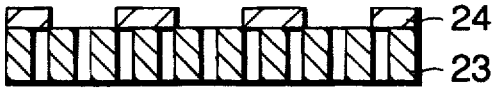
Figure 6C:
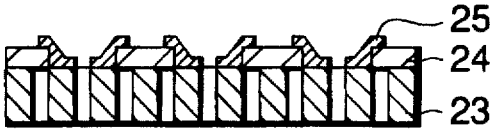
Figure 6D:
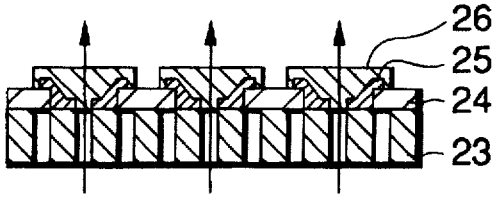
Figure 6E:
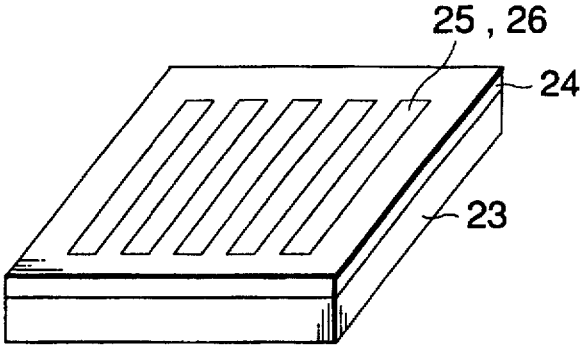

A method of fabricating a printing unit for producing a two-dimensional image will now be described with reference to FIGS. 6A to 6F. The method starts with providing a planar substrate 23 having a number of fine pores. Then, a resist or a spin-coated polymer (e.g. polyimide) layer 24 is formed over the substrate (see FIG. 6A). Then, with the resin or spin-coated layer 24 being made thicker (5 μm or more) than the diameter of the fine pores, a pattern for electrodes is formed by a photolithographic process and the unwanted areas are removed with a solvent, whereby the fine pores in the areas other than those where the electrode pattern is to be formed are closed with a resist or some other material (see FIG. 6B). In the next step, a thin metal (e.g. Pt) film is formed by sputtering or vapor deposition and subjected to a conventional photolithographic process to form an electrode pattern 25 (see FIG. 6C). Thereafter, an electrolytic oxidative polymerizer of the type shown in FIG. 1A is used to form thin polypyrrole films 26 over the electrodes 25 (see FIG. 6D). When the resulting assembly is used as a substrate, ionic dye molecules will flow in the direction indicated by arrows. The electrode pattern 25 consists of lines arranged as shown in FIG. 6E. The conductors for the electrodes may be driven by either simple matrix or TFT matrix accessing. The thus prepared substrate is incorporated as a printing unit into an apparatus of the type shown in FIG. 7.

Figure 6F:
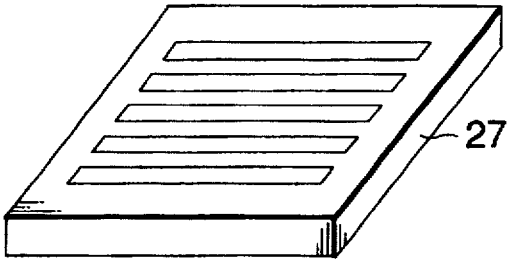

A substrate solely consisting of electrodes is shown in FIG. 6F and has lines of electrodes so arranged as to be perpendicular to the electrodes shown in FIG. 6E. Again the conductors for the electrodes shown in FIG. 6F may be driven by either simple matrix or TFT matrix accessing, provided that adjacent elements are isolated at each crossing point of the matrix. The thus prepared substrate is incorporated as an electrode unit into the apparatus shown in FIG. 7.

Figure 7:
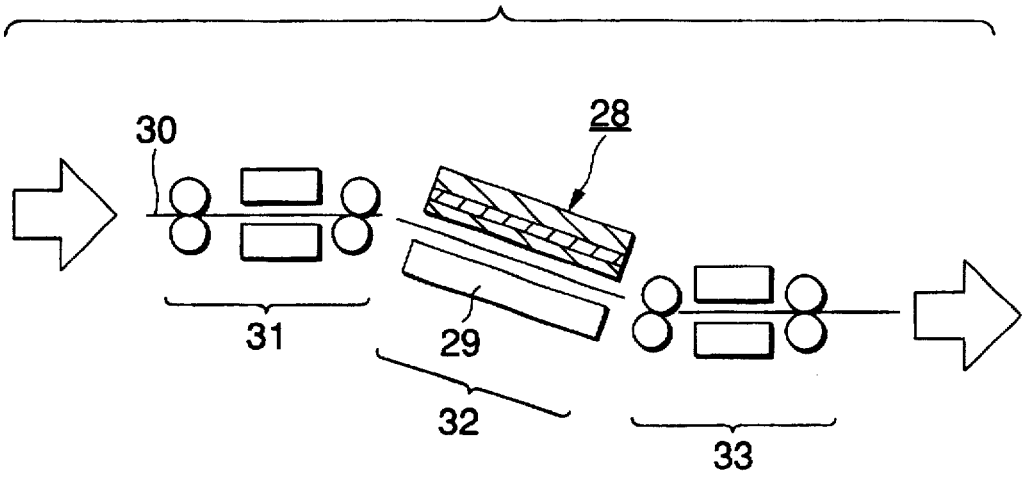
FIG. 7 shows schematically an image forming apparatus that employs the printing unit fabricated by the method shown in FIGS. 6A to 6F.

A method of forming a two-dimensional image and a printing method employing that image forming method will now be described with reference to FIG. 7. The system shown in FIG. 7 employs a printing unit and an electrode unit that have been fabricated by the method illustrated in FIGS. 6A to 6F. The printing unit shown in FIG. 6E and which is indicated by 28 in FIG. 7 and the electrode unit shown in FIG. 6F and which is indicated by 29 in FIG. 7 are positioned in registry with each other such that a voltage can be applied between the two units. In the system shown in FIG. 7, a sheet of paper 30 is fed from left to right in the direction of arrows. The sheet 30 is first directed to dampening zone 31, where a pad containing an aqueous NaCl solution is stamped onto the sheet 30. As a result, the entire surface of the sheet 30 becomes wet with the aqueous NaCl solution. The wet sheet 30 is guided by roll pairs to flow into a printing zone 32, where the printing unit 28 and the electrode 29 are inclined slightly downward to ensure that the ink will spread to all electrodes. The incoming sheet 30 is brought into intimate contact with both the printing unit 28 and the electrode unit 29. When a voltage is applied to an address, printing is effected in only the areas where the voltage has been applied, thereby forming a two-dimensional image. Since the as-printed sheet 30 is still wet, the entire part of it is subsequently dried in a heating zone 33, which completes the printing process.

Another method of fabricating a printing unit will now be described. First, an elongated planar transparent substrate having a number of fine pores is provided and a thin film of p-type a-Si is formed on the substrate by plasma-assisted CVD. A lead wire is attached onto the thin film of p-type a-Si to provide ohmic contact. When the substrate is submerged in an aqueous solution containing dye ions and pyrrole as shown in FIG. 1A, the lead wire serves as a working electrode. By subsequent electrolytic oxidative polymerization, a thin polypyrrole film is formed over the thin film of p-type a-Si. The resulting assembly is fitted with a case to contain dye ions that is formed of a transparent material. By filling the case with dye ions, a printing unit is fabricated.

Figure 8A:
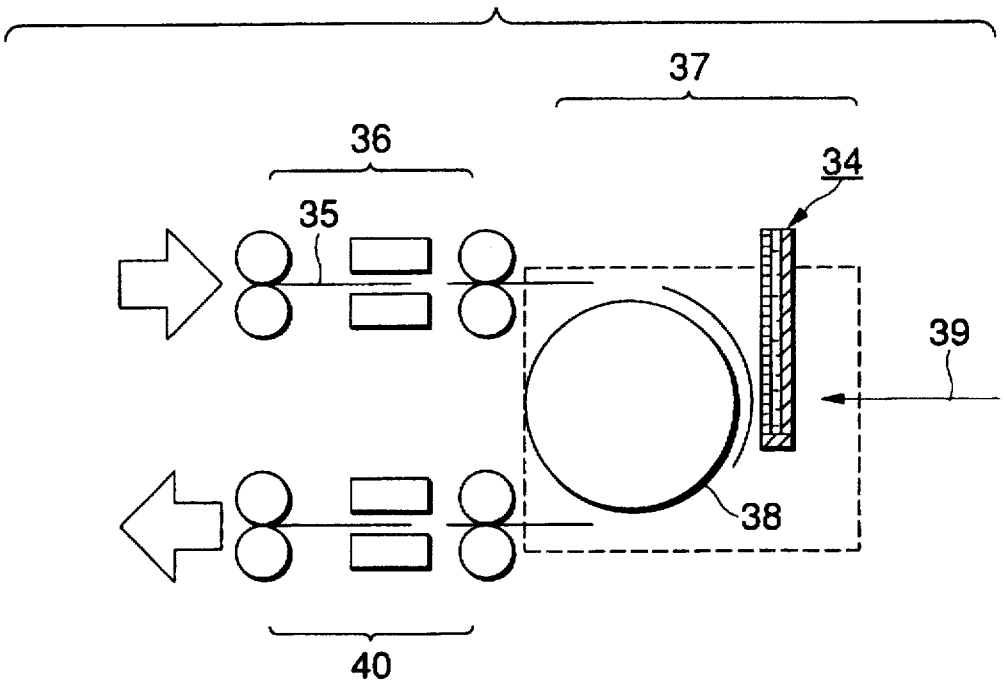
FIG. 8A shows schematically another example of the image forming apparatus of the invention.

The thus fabricated printing unit may be incorporated in an image forming apparatus as shown in FIG. 8A, in which the printing unit is indicated by 34. A sheet of paper 35 flows in the indirections indicated by arrows; first, it runs from left to right, moves around the electrode unit 38, changes direction at the bottom and runs from right to left. As shown, the sheet 35 is first directed to dampening zone 36, where a pad containing an aqueous solution of NaCl is stamped onto the sheet 35. As a result, the entire surface of the sheet 35 is guided by roll pairs to flow into a printing zone 37.

In the printing zone 37, the sheet 35 is fed between the printing unit 34 and a roll of electrode unit 38 which is made of either a substrate having a thin metal film formed over the entire surface or a metal drum. The electrode unit 38 is equipped with the necessary conductor pattern to permit voltage application. With the sheet 35 being held in intimate contact with both the printing unit 34 and the roll of electrode unit 38, laser light 39 is applied to the printing unit 34, whereupon dye ions are released from the irradiated areas of the printing unit 34. The image forming optics is the same as the scanning optics for a laser printer that is typically illustrated in FIG. 8B; a beam issuing from a semiconductor laser 41 is deflected by a polygonal mirror 42 to irradiate the printing unit 34. As a result, dye ions that have been released from the printing unit 34 are transferred onto the sheet 35 moving in synchronism with the rotating electrode unit 38, thereby producing a print of two-dimensional image. Since the as-printed sheet 35 is still wet, the entire part of it is subsequently dried in a heating zone 40, which completes the printing process.

Figure 8B:
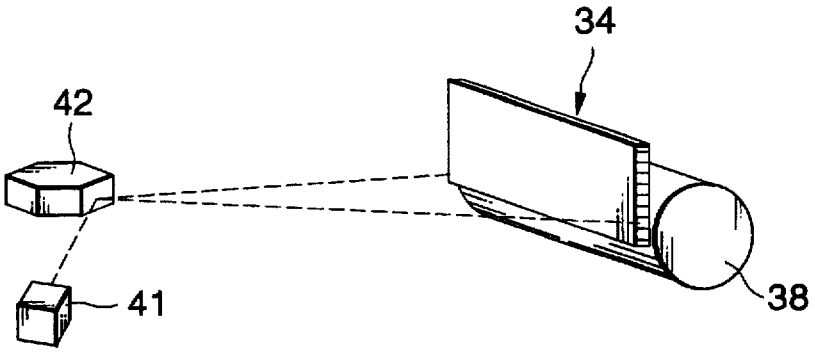
FIG. 8B illustrates how the image forming apparatus of FIG. 8A is irradiated with laser light.
Figure 9A:
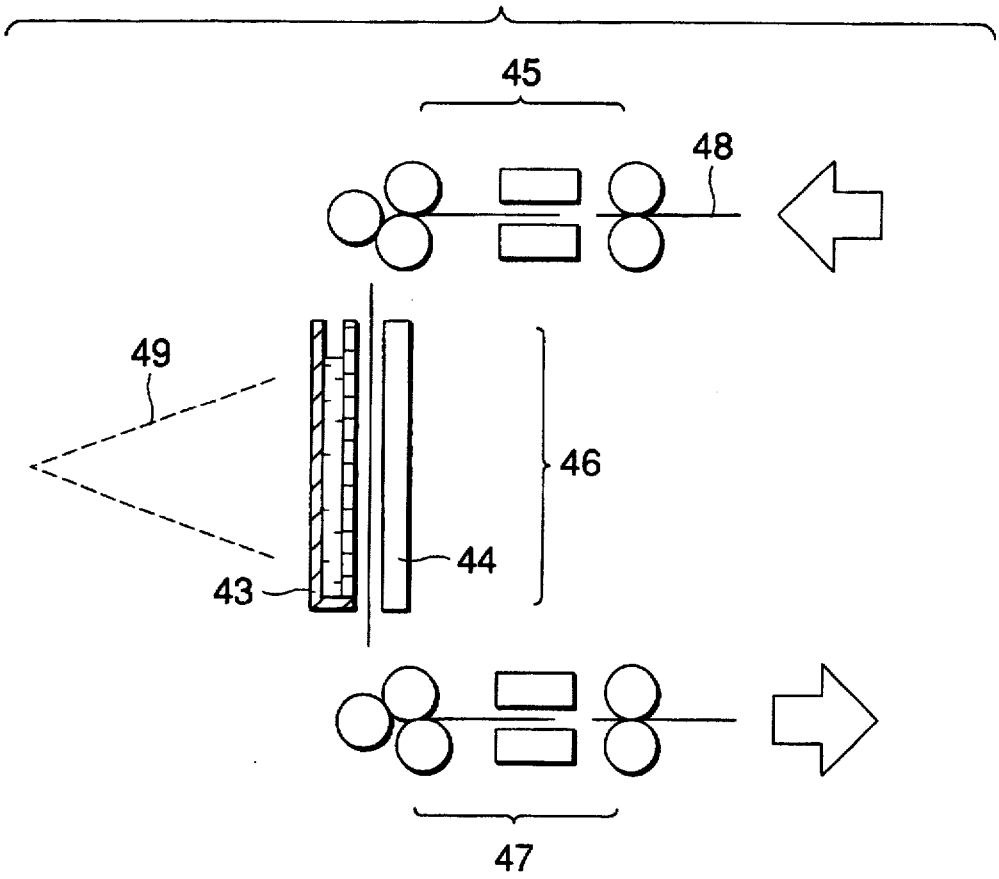
FIG. 9A shows schematically yet another example of the image forming apparatus of the invention.

A printing unit was fabricated by the same method as used to fabricate the printing unit incorporated in the image forming apparatus shown in FIGS. 8A and 8B. The thus fabricated printing unit was incorporated in an image forming apparatus of the type shown in FIGS. 9A and 9B, which comprises the printing unit 43, an electrode unit 44, a dampening zone 45, a printing zone 46 and a heating zone 47. A sheet of paper 48 flows in the directions indicated by arrows; first, it runs from right to left, then changes direction to move downward, makes another change in direction and moves from left to right. As shown, the sheet 48 is first directed to dampening zone 45, where a pad containing an aqueous solution of NaCl is stamped onto the sheet 48. As a result, the entire surface of the sheet 48 becomes wet with the aqueous solution of NaCl. The wet sheet 48 is guided by roll pairs to flow into a printing zone 46.

Figure 9B:
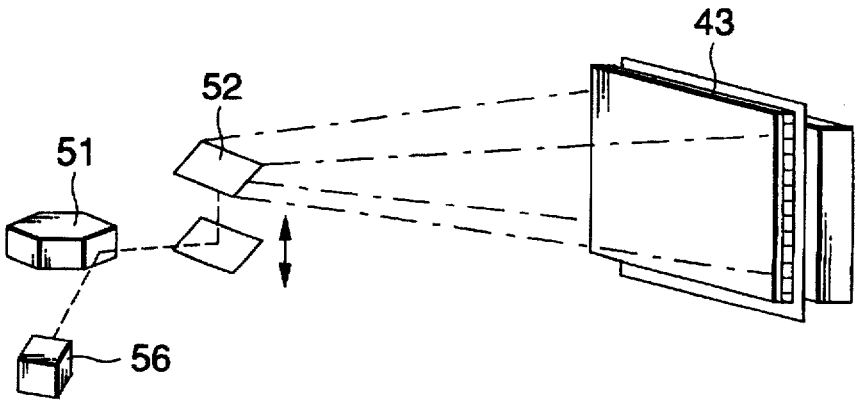
FIG. 9B illustrates how the image forming apparatus of FIG. 9A is irradiated with laser light.

In the printing zone 46, the sheet 48 is fed between the printing unit 43 and a planer electrode unit 44 made of either a substrate having a thin metal film formed over the entire surface or a metal plate. The electrode unit 44 is equipped with the necessary conductor pattern to permit voltage application. With the sheet 48 being held in intimate contact with both the printing unit 43 and the planar electrode unit 44, laser light 49 is applied to the printing unit 43, whereupon dye ions are released from the irradiated areas of the printing unit 43. The image forming optics is as shown in FIG. 9B; a beam issuing from a semiconductor laser 50 is deflected two-dimensionally by means of a polygonal mirror 51 and a galvanometer mirror 52 to irradiate the printing unit 43. As a result, the desired two-dimensional image is printing on the paper 48.

The following examples are provided for the purpose of further illustrating the present invention but are in no way to be taken as limiting.

EXAMPLE 1

The method illustrated in FIGS. 4A and 4B was used in this example. A cylindrical substrate 14 made of a high polymeric material that was 30 mm in diameter and 200 mm in length and which had fine (1 μm) pores in the wall was provided with a thin (300 Å) Pt film on the surface by sputtering. The substrate 14 was then placed in a vessel containing 0.02M ionic dye (rose bengal) molecules and 0.06M pyrrole. Electrolytic oxidative polymerization was performed at 0.8 V for 10 sec to form a thin polypyrrole film on the surface of the substrate 14.

The substrate 14 thus provided with the thin polypyrrole film was incorporated as a printing unit 16 in an image forming apparatus of the type shown in FIG. 5. The electrode unit 22 consisted of an array of metal electrodes each having a width of 20 μm. When a negative voltage of −1.2 V was applied between the printing unit 16 and the electrode unit 22, ionic dye molecules were released from the printing unit 16 to form an image on the sheet of paper 17.

EXAMPLE 2

The method illustrated in FIGS. 6A to 6F was employed to form a Pt electrode pattern 25 having an area of 20 μm×20 μm over a Si substrate 23 having fine (1 μm) pores in the surface. Thereafter, electrolytic oxidative polymerization was performed with a polymerizer of the type shown in FIG. 1A under the same conditions as employed in Example 1 to form a thin polypyrrole film over the electrode pattern. The thus treated substrate 23 was incorporated as a printing plate 28 in an image forming apparatus of the type shown in FIG. 7, with a 0.01M NaCl solution being contained in the dampening zone 31. When a negative voltage of −1.5 V was applied between the printing unit 28 and the electrode unit 29, an image was formed in only the areas of the substrate where the voltage was applied.

EXAMPLE 3

A transparent substrate made of a high polymeric material which had fine (1 μm) pores in the surface was provided with a thin film of p-type a-Si by plasma-assisted CVD. The thus treated substrate was set up in an apparatus of the type shown in FIGS. 1A and 1B and subjected to electrolytic oxidative polymerization at 4.2 V for 30 sec, whereby a thin polypyrrole film was formed on the thin film of p-type a-Si. The thus treated substrate was incorporated as a printing unit 34 in an image forming apparatus of the type shown in FIGS. 8A and 8B, with a 0.01M NaCl solution being contained in the dampening zone 36. When a negative voltage of −4 V was applied between the printing unit 34 and the electrode unit 38 under irradiation with laser light, an image was formed on the sheet of paper 35 in accordance with the pattern of laser irradiation.

Thus, according to the method of the invention, a thin electrically conductive high polymer film through which ionic dye molecules can pass in a controlled manner is adapted to be constantly supplied with said ionic dye molecules; in this way, the transmission of the ionic dye molecules can be controlled continuously at a molecular level to ensure continuous or intermittent formation of a sharp image.

The thus produced sharp image with the controlled transmission of ionic dye molecules can be effectively transferred onto a recording medium by transfer means in the apparatus of the invention.

It should further be apparent to those skilled in the art that various changes in form and detail of the invention as shown and described above may be made. It is intended that such changes be inclined with the spirit and scope of the claimed appended hereto.

What is claimed is:

1. An image forming method which comprises transferring ionic dye molecules onto a recording medium by making use of a difference in transmittance of said ionic dye molecules through an electrically conductive polymer film doped with said ionic dye molecules, said difference in transmittance being observed between at least two states of said polymer film, said state being selected from the group consisting of oxidized, neutral and reduced states.

2. An image forming method according to claim 1, wherein the transmittance of ionic dye molecules through the electrically conductive polymer film between said two states is controlled electrochemically.

3. An image forming method according to claim 2, wherein the transmittance of ionic dye molecules through the electrically conductive polymer film between said two states is controlled electrochemically under irradiation with light.

4. An image forming method according to claim 1, wherein said electrically conductive polymer film is formed on a substrate.

5. An image forming method according to claim 4, wherein said substrate is made of metal.

6. An image forming method according to claim 4, wherein said substrate has a metal film on a surface thereof and wherein said electrically conductive polymer film is formed on said metal film.

7. An image forming method according to claim 4, wherein said substrate is made of semiconductor.

8. An image forming method according to claim 4, wherein said substrate has a semiconductor film on a surface thereof and wherein said electrically conductive polymer film is formed on said semiconductor film.

9. An image forming method according to claim 1, wherein said electrically conductive film transmits said ionic dye molecules in the oxidized state and suppresses transmission of said ionic dye molecules in the neutral state.

* * * * *